United States Patent [19]

Buan et al.

[11] Patent Number: 4,929,106

[45] Date of Patent: May 29, 1990

[54] PLATEN MODULE

[75] Inventors: Danilo P. Buan, Easton; Jovito N. Abellana, Trumbull; Donald T. Dolan, Ridgefield, all of Conn.

[73] Assignee: Pitney Bowes Inc., Stamford, Conn.

[21] Appl. No.: 256,513

[22] Filed: Oct. 12, 1988

[51] Int. Cl.[5] ..... B41J 11/08

[52] U.S. Cl. ..... 400/649; 400/656; 400/662; 400/356

[58] Field of Search ..... 101/217; 400/661, 662, 400/356, 656, 661.3, 662 F, 48 F

[56] References Cited

U.S. PATENT DOCUMENTS

| | | | |
|---|---|---|---|
| 3,244,096 | 4/1966 | Riley | 101/297 |
| 3,480,127 | 11/1969 | Hesse et al. | 400/662 |
| 3,912,068 | 10/1975 | Kwan et al. | 400/56 |
| 3,915,089 | 10/1975 | Schubert | 101/232 |
| 3,920,113 | 11/1975 | Tamai | 400/662 |
| 3,995,730 | 12/1976 | Kwan et al. | 400/124 |
| 4,018,154 | 4/1977 | Matsumoto et al. | 101/93.02 |
| 4,215,946 | 8/1980 | Nakabo et al. | 400/661 |
| 4,318,452 | 3/1982 | Reitner | 400/661 |
| 4,420,269 | 12/1983 | Ackermann et al. | 400/356 |
| 4,489,651 | 12/1984 | De Luca et al. | 400/48 |
| 4,620,807 | 11/1986 | Polit | 400/56 |
| 4,676,675 | 6/1987 | Suzuki et al. | 400/56 |
| 4,689,639 | 8/1987 | Kimura et al. | 400/356 |
| 4,737,046 | 4/1988 | Inabata | 400/661 |

FOREIGN PATENT DOCUMENTS

| | | | |
|---|---|---|---|
| 265799 | 5/1988 | European Pat. Off. | 400/662 |
| 692775 | 6/1940 | Fed. Rep. of Germany | 400/661.3 |
| 136377 | 10/1981 | Japan | 400/662 |
| 19567 | 1/1985 | Japan | 400/656 |
| 222764 | 10/1986 | Japan | 400/48 |
| 2175854 | 12/1986 | United Kingdom | 400/656 |

OTHER PUBLICATIONS

Helinski et al, "Flexible Platen . . . ", IBM Tech. Disclosure Bulletin, vol. 26, No. 2, pp. 596–597, 7–83.

*Primary Examiner*—Edgar S. Burr
*Assistant Examiner*—M. Patel
*Attorney, Agent, or Firm*—Donald P. Walker; Melvin J. Scolnick; David E. Pitchenik

[57] ABSTRACT

An article of manufacture is provided which includes a molded piece-part having a substantially rectangularly-shaped plate portion including opposed surfaces. The piece-part also includes a pair of elongate parallel-spaced rack gear portions depending from one of the surfaces of the plate portion. The article further includes a member made of a resilient material having an inner surface facing the other of the surfaces of the plate portion and fixedly attached thereto. Moreover, the member includes a plurality of intersecting channels extending into the member from the inner surface thereof.

25 Claims, 2 Drawing Sheets

PLATEN MODULE

BACKGROUND OF THE INVENTION

This invention is generally concerned with printing apparatus for marking letters and more particularly with flat bed printing apparatus for marking letters including envelopes, stuffed envelopes, irregularly-shaped letters and letter mail, including self-mailers and stepped mail.

A significant proportion of the approximately one-half billion irregularly-shaped letters, flats, parcels, and other irregularly-shaped mailpieces, such as stepped letter mail, hotel keys, bagged film and the like, which are annually received by the U.S. Postal Service for processing, must be manually processed due to the lack of automated equipment. In the case of stepped, and other irregularly-shaped letter mail, automatic separation equipment is available for separating such mail from the main stream of incoming mailpieces, but there has been a long felt need for reliable machinery for handling other processing tasks. In particular, manual processing is heavily relied upon for performing such functions as cancelling the postage of stepped and other irregularly-shaped letter mail, and marking the same with appropriate destination bar codes for subsequent sorting. Moreover, the marking function implemented in the course of processing irregularly-shaped letter mail ranks amongst the highest of the labor intensive activities engaged in by Postal Services on a worldwide basis.

Of course, large private mailers of stepped and other irregularly-shaped letters are similarly burdened with labor intensive processing activities, including applying addresses, postage indicia and bar codes to such letters for delivery to the Postal Service.

For marking letters, such as envelopes, stuffed envelopes, irregularly-shaped letters and letter mail including self-mailers and stepped mail, mailing machines have been provided with postage printing apparatus which includes indicia marking structure and platen structure including a platen having an elastomeric member mounted thereon. To accommodate marking letters of varying thicknesses fed to the platen structure, the platen is lowered to receive a given letter on the elastomeric member, and then raised towards the indicia marking structure for marking the letter. In this connection, reference is made to U.S. patent application Ser. No. 135,186 for a Platen Module For A Modular Mailing Machine, filed Dec. 18, 1987 by Jovito N. Abellana et al and assigned to the assignee of the present invention, the subject matter of which is incorporated in this application by reference.

Moreover, thermal transfer printing apparatus of the type which includes a thermal printhead and thermal ink transfer ribbon, has been provided with a flexible roller for applying backing pressure to a letter fed between the ribbon and roller as the thermal printhead heats and applies pressure to the ribbon for transferring ink from the ribbon to the letter for marking the same. In this connection, reference is made to U.S. patent application Ser. No. 138,427 for Apparatus For Processing Irregularly-Shaped Letters In A Thermal Printer, filed Dec. 28, 1987 by Patrick Murphy et al and assigned to the assignee of the present invention, now Pat. No. 4,857,942 issued Aug. 15, 1989, and the references cited therein.

The flexible roller embodiments shown in the aforesaid Murphy et al Application include those having a cylindrically-shaped body portion provided with one or more channels extending thereinto from the outer surface of the body portion, as a result of which a plurality of spaced apart portions of the roller body portion contact a given letter fed to the thermal printer along a line extending transverse to the path of travel of both the thermal ink transfer ribbon and the given letter. And, one of the roller embodiments shown in the Murphy et al Application has a cylindrically-shaped roller body portion including one or more apertures formed therein and extending longitudinally of the length of the roller body portion.

It has been found that the printing quality of printing on letters, including envelopes, stuffed envelopes, irregularly-shaped letters and letter mail, including self-mailers and stepped mail, in a flat bed printer, is enhanced by providing an improvement in the platen member mounted on the platen of the platen module disclosed in the aforesaid Abellana et al Application. The improved platen member is preferably a resilient member, made of an elastic material, and includes a plurality of intersecting channels which extend upwardly from the inner surface of the member, rather than downwardly from the outer surface of the member, whereby the member does not include the spaced-apart letter contacting portions, or the apertures, shown in the Murphy et al Application. Moreover, it has been found that since the flexibility of the improved member in a flat bed printer affords the application of varying back pressure, against the printing die of the postage metering module, the grey scale level of the print on letters is substantially completely uniform. Accordingly:

An object of the invention is to provide apparatus for enhancing the printing quality provided by flat bed printing apparatus;

Another object is to provide improved apparatus for marking letters;

Another object to provide apparatus including improved means for resiliently urging a letter into engagement with a printing die;

Another object is to provide means for variably, resiliently supporting letters against the force exerted thereon by a printing die;

Another object is to provide a reciprocable platen, having a resilient, channeled, member mounted thereon, for use in flat bed printing apparatus;

Yet another object is to provide a platen assembly which includes a pair of rack gears, a platen integrally connected to the upper ends of the rack gear and supporting structure extending between the rack gears, which are manufactured as a single piece part, in combination with a resilient platen member according to the invention; and Another object is to provide flat bed printing apparatus which includes a flexible member, having a plurality of intersecting channels formed therein, mounted on platen which is reciprocable for movement of the member toward and away from a printing die.

SUMMARY OF THE INVENTION

An article of manufacture comprising: a molded piece-part including a substantially rectangularly-shaped plate portion having opposed surfaces, the piece-part including a pair of elongate parallel-spaced rack gear portions depending from one of the surfaces of the plate portion; and a member made of a resilient material, the member having an inner surface facing the other of the surfaces of the plate portion and fixedly attached thereto, and the member including a plurality of intersecting channels extending thereinto from the inner surface thereof.

BRIEF DESCRIPTION OF THE DRAWINGS

As shown in the drawings wherein like reference numerals designate like or corresponding parts throughout the several views.

DESCRIPTION OF THE PREFERRED EMBODIMENTS

Figure 1:
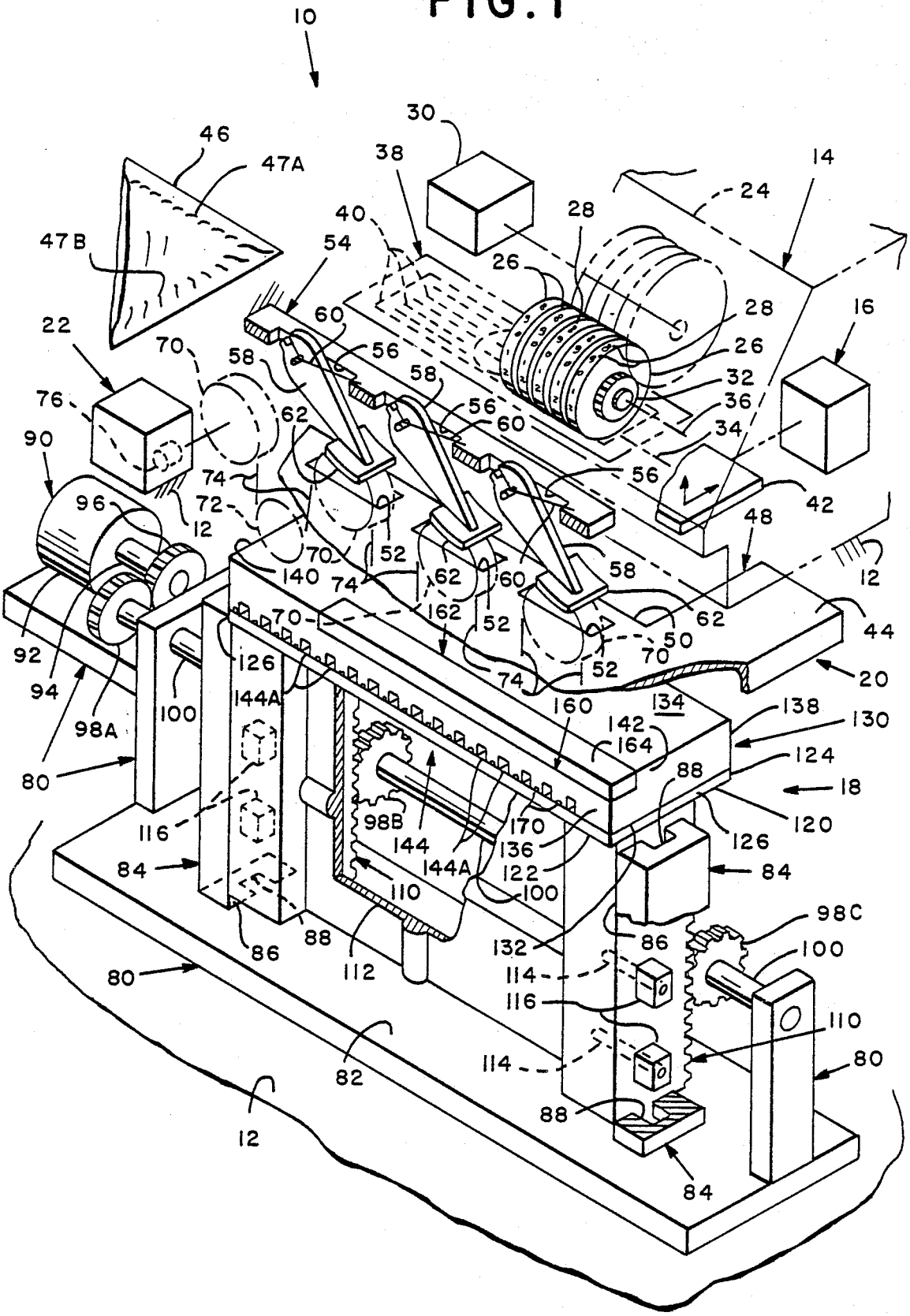
FIG. 1 is a schematic partially fragmentary, perspective view of a mailing machine including a platen module including a platen having mounted thereon a resilient platen member according to the invention.

As shown in FIG. 1, a mailing machine 10 of the type which may be improved in accordance with the present invention includes a base 12, and, conventionally removably connected to the base 12, a postage metering module 14, inking module 16, platen module 18, scale module 20 and letter transporting module 22.

The postage metering module 14 (FIG. 1) includes a conventional housing 24, and includes a plurality of printwheels 26 which are suitably connected to the housing 24 for rotation relative to the housing 24. Each of the printwheels 26 includes a plurality of fonts 28, which are located at spaced intervals along the outer periphery of the printwheel 26. In addition, the postage metering module 14 includes print wheel indexing structure 30, including a plurality of gears 32, one of which is shown. Each of the gears 32 is operably connected on a one-for-one basis to each of the printwheels 26, and is conventionally driven by the indexing structure 30 for independently indexing the printwheels 26 to selectively locate any given font 28, of any given printwheel 26, in a printing location situated along a line 34 extending parallel to the rotational axis 36 of the printwheels 26. The postage metering module 14 also includes printing structure 38 which includes a plurality of fixed printing elements 40. The printing elements 40 are located in a flat plane extending through the printing location of the aforesaid selectively located fonts 28, when such fonts 28 are situated in their printing location, whereby such fonts 28 and printing elements 40 collectively form a printing die, 28, 40. The printing structure 38 may also include an additional set of printwheels 26, each including a plurality of fonts 28, for date printing purposes. A more detailed description of the postage metering module 14 may be found in U.S. patent application Ser. No. 114,363 for A Removable Postage Meter Having An Indicia Cover, filed Oct. 27, 1987 by Gilbert N. Riley et al and assigned to the Assignee of the present invention.

The inking module 16 (FIG. 1) includes an ink bearing member 42, which is movable into and out of engagement with the printing die, 28, 40, when the selected fonts 28 are situated in the aforesaid printing location, for applying ink to the printing die, 28, 40, prior to each printing cycle.

The scale module 20 (FIG. 1) includes a horizontally-extending deck 44 for receiving letters 46 fed to the mailing machine 10. The letters 46 may be envelopes, stuffed envelopes, irregularly-shaped letters or letter mail, including self-mailers or stepped mail. Thus a given letter 46 may include either a longitudinally-extending step or ridge 47A, or transversely-extending step or ridge 47B, or both. The deck 44 has a rectangularly-shaped aperture 48 formed therein, which is partially defined by a forwardly located, longitudinally-extending, edge 50. In addition, the deck 44 has a plurality of smaller, rectangularly-shaped apertures 52 formed therein at spaced intervals situated along a line (not shown) which extends parallel to the aperture edge 50. The scale module 20 also includes a bar 54, which overhangs the deck 44 and has a plurality of slots 56 formed therein at evenly spaced intervals along the length of the bar 54. Further, the scale module 20 includes a plurality of ski-supporting arms 58. The upper ends of the arms 58 are located on a one-for-one basis within the slots 56 and are conventionally pivotably attached to the bar 54. The scale module 20 additionally includes a plurality of coil springs 60 which are suitably connected to the upper ends of the ski-supporting arms 58, on a one-for-one basis, and to the bar 54, for resiliently urging the lower ends of the arms 58 towards the deck 44. Moreover, the scale module 20 includes a plurality of upwardly curved ski members 62 which are connected to the lower ends of the ski supporting arms 58, on a one-for-one basis, such that the ski members 62 overhang the deck apertures 52 on a one-for-one basis.

The transporting module 22 (FIG. 1), includes a first plurality of rollers 70, which are rotatably supported at spaced intervals beneath the deck 44, such that their peripheries respectively extend upwardly into the deck apertures 52 on a one-for-one basis when the rollers 70 are rotating in one direction. In addition, the rollers 70 are suitably mounted to permit their being lowered in response to rotation thereof in the opposite direction. Further, the transporting module 22 including a second plurality of rollers 72, which are rotatably supported at spaced intervals beneath the deck 44 and below the level of the first rollers 70. The transporting module 22 also includes an endless belt 74 which is alternately looped about each of the first and second rollers, 70 and 72, whereby the belt 74 protrudes through the deck apertures 52, when the rollers are rotating in the aforesaid one direction and does not protrude through the deck apertures 52 when the rollers 70 are rotated in the opposite direction. Further, the transporting module 22 includes driving structure 76 for moving the belt 74 in one direction about the first rollers 70 for engaging and feeding a letter 46 which is fed to the deck 44, and for moving the belt 74 in the opposite direction, whereby the rollers 70 and thus the belt 74, are lowered for disengaging the belt 74 from the letter 46 to thereby position the letter in a predetermined location on the deck 44. A more detailed discussion of the structure of transporting module 22 may be found in the aforesaid Abellana et al Application.

According to the invention, the platen module 18 (FIG. 1) includes framework 80 which is conventionally removably attached to the mailing machine base 12, for removably connecting the platen module 18 to the remainder of the mailing machine 10. As thus mounted, the framework 80 includes a horizontally-extending base plate 82, and includes a pair of oppositely-spaced, upright, members 84, each of which has an inner surface 86. The inner surfaces 86 face each other and are vertically oriented parallel to one another. The upright members 84 each include a vertically oriented channel 88, which is formed in the member 84 from the inner surfaces 86 thereof. The channels 88 are each U-shaped in transverse cross-section and spaced-parallel to each other, such that the longitudinally-extending openings into the channels 88 are oriented in facing relationship with respect to each other.

The platen module 18 (FIG. 1) additionally includes a drive motor 90 having a housing 92 which is conventionally connected to the framework 80. The motor 90 includes a horizontally-extending output shaft 94. In addition, the platen module 18 includes an output drive gear 96, which is conventionally fixedly mounted on the motor output shaft 94, and includes first, second and third pinion gears, respectively designated 98A, 98B and 98C. Further, the platen module 18 includes a horizontally-extending pinion gear shaft 100 on which the gears 98A, 98B and 98C are conventionally fixedly mounted, at spaced intervals along the length of the shaft 100. The pinion gear shaft 100 is suitably rotatably connected to the framework 80, such that the pinion gear 98A is disposed in meshing engagement with the drive gear 96. Further, the platen module 18 includes a pair of vertically oriented rack gears 110 which are spaced parallel to each other. Moreover, the platen module 18 includes rack gear supporting structure 112, preferably a strut in the form of a wall, which extends between and is fixedly connected to the rack gears 110. The rack gears 110 are disposed in sliding engagement with the upright members 84, on a one-for-one basis, as hereinafter discussed in greater detail. As thus disposed, the rack gears 110 are also disposed in meshing engagement with the pinion gears 98B and 98C, on a one-for-one basis. Thus, appropriate rotation of the pinion gear 98A by the drive motor 90 results in raising or lowering the respective rack gears 110. And, since the supporting wall 112, is fixedly connected to the rack gears 110, the rack gears 110 are raised or lowered, as the case may be, in unison with one another.

To effectuate sliding engagement of each rack gear 110 (FIG. 1) with the upright member 84 with which it is associated, the platen module 18 includes a pair of parallel spaced, horizontally-extending members 114, preferably dowels, which are fixedly connected to each of the rack gears 110. Each of the dowels 114 extends from the rack gear 110 to which it is connected and into the U-shaped channel 88 of the associated upright member 84. Moreover, the platen module 18 preferably includes a plurality of replaceable, solid rectangularly-shaped bearing members 116, preferably made of a plastic material. The bearing members 116 are rotatably mounted on the dowels 114 on a one-for-one basis. The members 116 are each externally dimensioned for sliding engagement with each of the channels 88 to permit the members 116 to be interchangeably mounted on the dowels 114. Without departing from the spirit and scope of the invention, the dowels 114 may be dimensioned for disposition in sliding engagement with the channels 88, in which instance the provision of bearing members 116 will have been obviated due to the dowels 114 acting as bearing members.

The platen module 18 (FIG. 1) further includes a rectangularly-shaped plate 120 which is fixedly mounted on the upper ends each of the rack gears !10 for movement therewith. The plate 120 has opposed front and rear edges, 122 and 124 respectively, which extend lengthwise of the plate 120, and has opposed end edges 126, which extend transversely between the front and rear edges 122 and 124.

Figure 2:
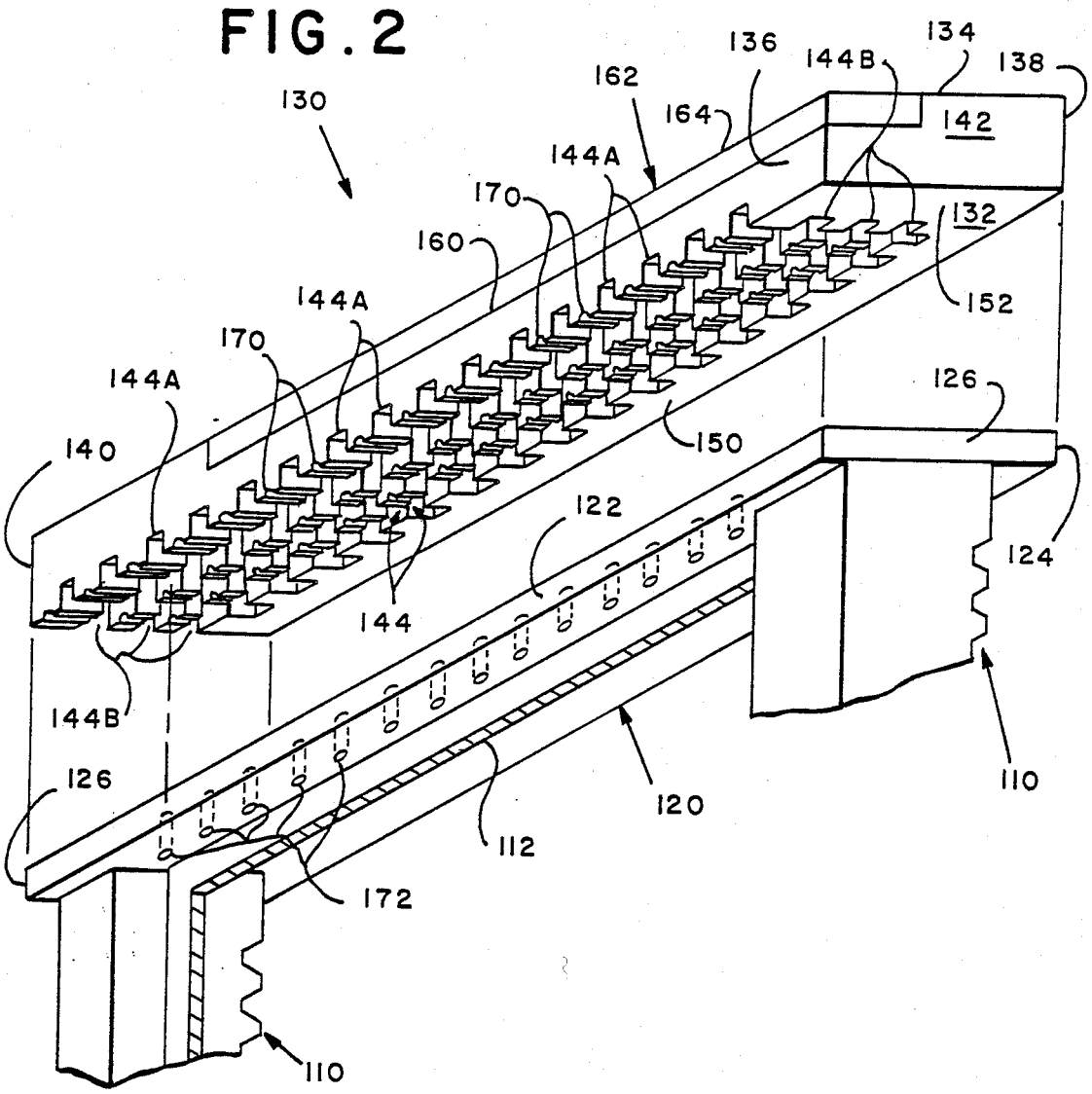
FIG. 2 is perspective view of the flexible member shown in FIG. 1 showing details of the intersecting channels formed therein from the lower surface thereof.

According to the invention, the platen module 18 (FIG. 1) additionally includes a resilient platen member 130, which is preferably made of an elastic material, such as rubber or a rubber-like material, including but not limited to an elastomeric material. The platen member 130 is preferably rectangularly-shaped and has lower and upper surfaces, 132 and 134 respectively, which are preferably flat surfaces. Further, the platen member 130 has front and rear edges, 136 and 138 respectively, which extend lengthwise of the member 130, and has opposed leading and trailing end edges, 140 and 142 respectively, which extend transverse to and between the front and rear edges 136 and 138. In addition, the platen member 130 includes a plurality of intersecting channels 144 (FIG. 2) formed therein.

The channels 144 (FIG. 2) each extend into the platen member 130 from the lower surface 132 thereof, and preferably have an inverted U-shape transverse cross-section, as viewed from the front edge 136 of the platen member 130 when the upper surface 134 thereof is facing upwardly. The channels 144 preferably comprise a plurality of parallel-spaced, transversely-extending, channels 144A which are located at evenly spaced intervals between the opposed end edges 140 and 142. The channels 144A intersect the platen member's front edge 136, but not the rear edge 138, as a result of which the front edge 136 tends to flex more readily than the rear edge 138 when downward pressure is exerted on the upper surface 134 of the platen member 130. The channels 144 also preferably comprise a plurality of parallel-spaced, longitudinally-extending, channels 144B which are located at evenly spaced intervals between the front and rear edges 136 and 138. The channels 144B intersect the platen member's leading end edge 140 and each of the channels 144A, but do not intersect the trailing end edge 142, as a result of which the leading end edge 140 tends to flex more readily than the trailing end edge 142 when downward pressure is exerted on the upper surface of the platen member 130. As thus constructed, the platen member 130 includes a longitudinally-extending rear portion 150, which is bounded by the rear edge 138 and a plane extending through the rear ends of the channels 144A. Further, the platen member 130 includes a transversely-extending trailing end portion 152 which is bounded by the trailing end edge 142 and a plane extending through the trailing ends of the channels 144B. Moreover, the longitudinally-extending rear portion 150, and transversely-extending trailing end portion 152, are each less flexible than the remainder of the platen member 130. In addition, the platen member 130 includes an elongate, rectangularly-shaped ledge 160 formed therein, which longitudinally extends from the trailing end edge 142, along the front edge 136 but not to the leading end edge 140. Thus, the ledge 160 is not coextensive in length with the front edge 136. The platen module 18 additionally includes a rectangularly-shaped, flat member 162 which is made of a substantially inflexible metal, metallic or plastic material, and has substantially the same dimensions as the ledge 160. The member 162 is mounted on the ledge 160 and is suitably fixedly attached to the platen member 130 as by means of an adhesive substance. As thus mounted, the member 162 extends marginally along the front edge 136 of the platen member 130, and the upper surface 164 of the member 162 lies in the same plane as the upper surface 134 of the platen member 130. When downward pressure is exerted on its upper surface 164 of the member 162, the downward forces occasioned thereby are distributed along the length and width of the member 162, and thus along a marginal portion of the platen member 130 which is coextensive in length and width with the ledge 160.

For rapidly venting compressed air from the channels 144 (FIG. 2) when a downward force is exerted on the upper surface 134 of the platen member 130, the platen member 130 may either include a plurality of additional channels 170 which extend into the platen member 130 from the lower surface 132 thereof or a plurality of apertures 172 formed in the plate 120. Assuming the provision of additional channels 170, the channels 170 are preferably semi-circularly shaped in transverse cross-section, parallel-spaced with respect to one another and transversely-extend into the platen member 130, from the front edge 136 thereof, at evenly spaced intervals between the opposed end edges 140 and 142. Moreover, the channels 170 extend parallel to the channels 144A and intersect each of the channels 144B. Assuming the provision of the apertures 172, the apertures 172 are preferably located at the intersections of the respective channels 144A and 144B.

According to a second embodiment of the invention, the rack gears 110 (FIGS. 1 and 2), supporting wall 112 and plate 120 are preferably manufactured as a single piece-part made of a molded plastic material which includes portions corresponding to the gears 110, wall 112 and plate 120. As thus constructed the gear portions 110 depend from the inner surface of the plate, and the strut, or wall, portion 112 extends between the inner surfaces of the respective gear portions 110. Moreover, the piece-part, 110, 112, 120, is preferably provided as a piece-part 110, 112, 120 of a platen assembly which also includes the platen member 130, fixedly connected to the plate portion 120, and includes the flat member 162 fixedly connected to and embedded in the platen member 130. Without departing from the spirit and scope of the invention, the piece part 110, 112, 120 may additionally include as portions thereof, the two pairs of horizontally-extending members or dowel portions 114. In which instance the dowell portions 114 would extend from the outer surfaces of the rack gear portions 110. As thus constructed and arranged the piece-part 110, 112, 114, 120 is preferably combined with the platen member 130 and flat member 162 as a replaceable platen assembly of the platen module 18. Of course, the dowel portions 114 of the piece-part 110, 112, 114, 120 may be either dimensioned for sliding engagement with the upright member channels 88 (FIG. 1) or, assuming the provision of replaceable bearing members 88, dimensioned for rotatably mounting replacement bearing members 88 thereon, as needed, when the platen assembly is slidably connected to the remainder of the platen module 18.

In operation, a letter 46 fed to the mailing machine 10 is fed between the first ski member 62 and the portion of the belt 74 which protrudes through the first deck aperture 52. The ski member 62 urges the letter 46 into engagement with the moving belt 74 against the force exerted thereagainst by the spring loaded arm 58. As the belt 74 feeds the letter 46, the letter 46 is moved downstream on the deck 44 beneath the postage metering module 14 and into overlying relationship with the deck aperture 48. Thus the remaining ski members 62 successively engage the upper surface of the letter 46 for urging the letter 46 into continuous engagement with the moving belt 74. When the leading edge of the letter 46 has arrived at a predetermined location, which, for the purposes of this discussion may be taken to be just beyond the downstream end of the deck aperture 48, then the first set of rollers 70, and thus the belt 74 looped thereabout, are lowered beneath the upper surface of the deck 44, as a result of which the belt 74 disengages the letter 46, thereby disposing the letter in a predetermined stationary position on the deck 44. The letter 46 is then weighed for postage calculation purposes, and the appropriate printwheels 26 are indexed for locating the appropriate fonts 28 corresponding to the postage value into the printing location along the line 34. At which juncture, the postage value is ready to be printed on the letter 46. A more detailed description of the aforesaid operation of the mailing machine 10 is set forth in the aforesaid U.S. patent application of Abellana et al.

According to the invention, after the above-described operation of the mailing machine 10 (FIG. 1.), the platen module 18 enters into a printing cycle of operation during which the motor 90 is conventionally energized for appropriately rotating the output shaft 94 to cause the drive gear 96 to drive the gear 98A, and thus the connected shaft 100, pinion gears 98B and 98C and meshing rack gears 110. The pinion gears, 98B and 98C, are initially appropriately rotated to drive the rack gears 110 upwardly, thereby raising the platen member 130 vertically upward and through the deck aperture 48, for urging the letter 46 on the platen member 130 into printing engagement with the printing die, 28, 40. Thereafter the pinion gears, 98B and 98C are appropriately rotated to drive the rack gears 110 downwardly, thereby lowering the platen member 130 vertically downward and through the deck aperture 48, for lowering the letter 46 out of printing engagement with the printing die, 28, 40 and back into engagement with the deck 44. Thus, the platen member 162 is reciprocably raised and lowered during the printing cycle. Thereafter, the transporting module 22 is conventionally operated for feeding the letter 46 downstream from beneath the postage metering module 14 and thus away from the mailing machine 10.

Figure 3:
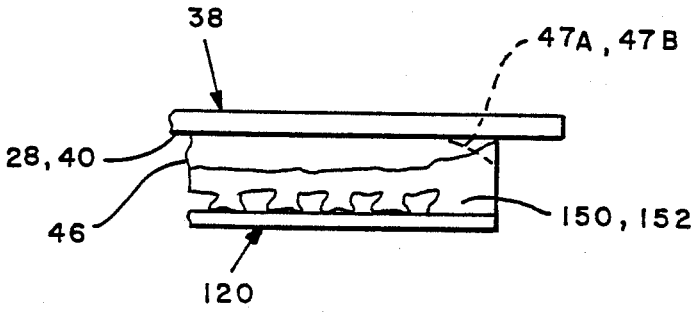
FIG. 3 is a side view of a portion of the platen module and printing module of FIG. 1, showing a letter urged, by the platen member according to the invention, into printing engagement with the printing die of the printing module.

In the course of the aforesaid printing cycle of operation of the platen module 18 (FIG. 1), the flat member 162, mounted on the platen member ledge 160, engages and lifts the ski members 62 upwardly against the force exerted thereon by the spring loaded arms 58, to prevent the ski members 62 from holding the letter 46 down against the force exerted on the letter 46 by the platen member 130, as the platen member 130 resiliently urges the letter 46 into engagement with the printing die, 28, 40. Moreover, as shown in FIG. 3, as the letter 46 is urged into engagement with the printing die 28, 40, and the platen member 130 is resiliently compressed against the letter 46, the upper surface 134 of the member 130 deforms to accommodate variations in thickness of the letter 46. As a result, the upper surface of the letter 46 is flattened against the printing die, 28, 40. As the platen member 130 deforms, air that may otherwise be trapped at the intersections of the channels 144A and 144B, due to collapse of the walls thereof, is vented from beneath the member 130 via the channels 170, or via the apertures 172. In this connection, it is noted that in practice, the speed with which the platen member 130 is compressed, during each printing cycle, varies from about 15 milliseconds for thick letters 46, i.e., those having a thickness of about three-quarters of an inch, to about 30 milliseconds for thin letters 46, i.e., those having a thickness of about one-sixteenth of an inch. Further, in the course of compression of the platen member 130, since the platen member's respective longitudinally-extending and transversely-extending portions, 150 and 152 (FIGS. 2), do not include channels 144 or 170 formed therein, the forces exerted on the letter 46 (FIG. 3) by the platen member 130, in the vicinity of the ridges 47A and 47B, are greater than those exerted on the letter 46 by the remainder of the member 130, thus ensuring that the upper surface of the letter 46 in the vicinity of the ridges, 47A and 47B, is flattened against the printing die 28, 40. As a result, the upper surface of the letter 46 in the vicinity of the ridges, 47A and 47B, is marked with the same degree of clarity as the remainder of the letter 46 is marked by the printing die 28, 40. Moreover, the grey scale level of printing on letters, including stepped letters and stepped mail, having either or both types of ridges, 47A or 47B, is substantially completely uniform.

In accordance with the objects of the invention there has been disclosed improved printing apparatus, including structure for enhancing the quality of printing on letters in flat bed printing apparatus, and improved apparatus for marking letters including structure for resiliently urging a letter into engagement with a printing die, as exemplified by the provision of a reciprocable platen having a resilient, channeled, member mounted thereon. Moreover, there has been disclosed an article of manufacture which includes a pair of rack gears, having integrally connected thereto a platen and supporting structure extending between the gears, in combination with a resilient platen member.

Since the implementation of other variations and modifications of the above discussed illustration embodiments of the invention will be apparent to those skilled in the art, the invention is not limited by the specific embodiments described. Rather, the following claims should be interpreted to cover the subject matter set forth therein and any equivalents thereof that fall within the true spirit and scope of the invention.

What is claimed is:

1. An article of manufacture comprising:

a. a molded piece-part including a substantially rectangularly-shaped plate portion having opposed surfaces, the piece-part including a pair of elongate parallel-spaced rack gear portions depending from one of the surfaces of the plate portion; and b. a member made of a resilient material, the member having an inner surface facing the other of the surfaces of the plate portion and fixedly attached thereto, and the member including a plurality of intersecting channels extending thereinto from the inner surface thereof.

2. The article according to claim 1, wherein the member has an outer surface, and the article including a strip of substantially inflexible material embedded in the member from the outer surface thereof and extending along a marginal longitudinally-extending side edge of the member.

3. The article according to claim 1, wherein the rack gear portions each include an outer surface, the gear portion outer surfaces extending parallel to each other, and the piece-part including a pair of parallel-spaced dowel portions extending from each of the gear portion outer surfaces.

4. The article according to claim 1, wherein said channels are respectively substantially U-shaped in transverse cross-section, said channels including a first plurality of longitudinally-extending channels and a second plurality of transversely-extending channels, and the first and second channels intersecting each other.

5. The article according to claim 1, wherein the piece-part includes a strut portion extending between the rack gear portions.

6. The article according to claim 1, wherein the member includes means for venting air from at least one of said channels.

7. The article according to claim 1, wherein the plate portion includes means for venting air from at least one of said channels.

8. An article of manufacturing comprising:

a. a molded piece-part including a substantially rectangularly-shaped plate portion having opposed surfaces, the piece-part including a pair of elongate parallel-spaced rack gear portions depending from one of the surfaces of the plate portion;

b. a member made of a resilient material, the member having an inner surface facing the other of the surfaces of the plate portion and fixedly attached thereto, the member including a plurality of intersecting channels extending thereinto from the inner surface thereof; and c. the member including opposed longitudinally-extending side edges and opposed transversely extending end edges, and the channels including a first plurality of parallel-spaced channels extending into the member from one of the side edges thereof and a second plurality of parallel-spaced channels extending into the member from one of the end edges thereof, the first channels intersecting only said one side edge and said second channels, and the second channels intersecting only said one end edge and said first channels, whereby said platen member includes a longitudinally-extending marginal portion and a transversely-extending marginal portion.

9. The article according to claim 8, wherein the member includes an outer surface, and the article including a strip of substantially inflexible material embedded in the member from the outer surface thereof.

10. In a platen module including a plate, means for supporting the plate for reciprocable movement thereof, a platen member including an inner surface thereof faced toward and fixedly connected to the plate for movement of the platen member therewith, and the member having an outer surface thereof faced away from the plate, an improvement comprising:

a. platen means including the platen member, the platen member made of a resilient material;

b. the platen member including a plurality of channels extending thereinto from the inner surface thereto; and c. the platen means including a strip of substantially inflexible material embedded in the platen member from the outer surface thereof; and d. the platen member including opposed longitudinally-extending side edges and opposed transversely-extending end edges, the channels including a first plurality of parallel-spaced channels extending into the member from one of the side edges thereof and a second plurality of parallel-spaced channels extending into the member from one of the end edges thereof, the first channels intersecting only said one side edge and each of the second channels, and the second channels intersecting only said one end edge and each of said first channels, whereby said platen member includes a longitudinally-extending marginal portion and a transversely-extending marginal portion.

11. The improvement according to claim 10, wherein said platen member has a longitudinally-extending edge, and said strip of material marginally extending along said edge.

12. The improvement according to claim 10, wherein said channels are respectively substantially U-shaped in transverse cross section.

13. The improvement according to claim 10, including means for venting air from an at least one of said channels when the platen member is subject to a force urging the outer surface towards the inner surface.

14. The improvement according to claim 13, wherein the air venting means includes an additional plurality of said channels.

15. The improvement according to claim 10, wherein the module includes framework, the supporting means including a pair of parallel-spaced rack gears, the supporting means including strut means connected to and extending between the rack gears, and the supporting means including means for slidably connecting the rack gears to the framework.

16. In a platen module including a plate, means for supporting the plate for reciprocable movement thereof, a platen member including an inner surface thereof faced toward and fixedly connected to the plate for movement of the platen member therewith, and the member having an outer surface thereof faced away from the plate, an improvement comprising:

a. platen means including the platen member, the platen member made of a resilient material;
b. the platen member including a plurality of channels extending thereinto from the inner surface thereof;
c. the platen means including a strip of substantially inflexible material embedded in the platen member from the outer surface thereof; and
d. means for venting air from an at least one of said channels when the platen member is subjected to a force urging the outer surface towards the inner surface, and the air venting means includes a plurality of apertures formed in the plate.

17. The improvement according to claim 16, wherein the supporting means includes a pair of parallel-spaced rack gears.

18. The improvement according to claim 17, wherein the module includes framework, the supporting means including means for slidably connecting the rack gears to the framework, the module including a motor connected to the framework, the motor including a output shaft and a drive gear mounted on the output shaft, the module including a second shaft rotatably connected to the framework, the module including a first pinion gear mounted on the second shaft and disposed in meshing engagement with the drive gear, and the module including second and third pinion gears mounted on the second shaft and disposed in meshing engagement with the rack gears on a one-for-one basis.

19. The improvement according to claim 18, wherein the plate and rack gears are a molded piece-part including portions thereof corresponding to said plate and said gears.

20. In a mailing machine including a plurality of modules, wherein one of said modules is a printing module having a printing die and another of said modules is a platen module having a platen member, and wherein the platen module includes means for supporting the platen member for reciprocable movement toward and away from the printing die, an improvement comprising:

a. the platen member made of a resilient material and including an outer surface faced toward the printing die and an opposed inner surface fixedly connected to the supporting means for movement of the platen member therewith; and
b. the platen member including a plurality of intersecting channels extending thereinto from the inner surface thereof.

21. The improvement according to claim 20, wherein said module includes a strip of substantially inflexible material embedded in the platen member from the outer surface thereof.

22. The improvement according to claim 20, wherein the module includes framework, the supporting means including a pair of parallel-spaced rack gears, the platen member connected to the rack gears, a motor connected to the framework, the motor including an output shaft and a drive gear mounted on the shaft, the module including a second shaft rotatably connected to the framework and including a first pinion gear mounted thereon and disposed in meshing engagement with the drive gear, and the module including second and third pinion gears mounted on the second shaft and disposed in meshing engagement with the rack gears on a one-for-one basis.

23. The improvement according to claim 20, wherein the platen member includes means for venting air from at least one of said channels.

24. The improvement according to claim 20, wherein the supporting means includes means for venting air from at least one of said channels.

25. In a mailing machine including a plurality of modules, wherein one of said modules is a printing module having a printing die and another of said modules is a platen module having a platen member, and wherein the platen module includes means for supporting the platen member for reciprocable movement toward and away from the printing die, an improvement comprising:

a. the platen member made of a resilient material and including an outer surface faced toward the printing die and an opposed inner surface fixedly connected to the supporting means for movement of the platen member therewith;
b. the platen member including a plurality of intersecting channels extending thereinto from the inner surface there, and
c. the platen member including opposed longitudinally-extending side edges and opposed transversely-extending end edges, said channels including a first plurality of parallel-spaced channels extending into the member from one of the side edges thereof and a second plurality of parallel-spaced channels extending into the member from one of the end edges thereof, the first channels intersecting only said one side edge and each of the second channels, and the second channels intersecting only said one end edge and each of said first channels, whereby side platen member includes a longitudinally-extending marginal portion and transversely-extending marginal portion.

* * * * *